US005796848A

United States Patent [19]

Martin

[11] Patent Number: 5,796,848

[45] Date of Patent: Aug. 18, 1998

[54] DIGITAL HEARING AID

[75] Inventor: Raimund Martin, Eggolsheim, Germany

[73] Assignee: Siemens Audiologische Technik GmbH, Erlangen, Germany

[21] Appl. No.: 761,495

[22] Filed: Dec. 6, 1996

[30] Foreign Application Priority Data

Dec. 7, 1995 [DE] Germany ..... 195 45 760.9

[51] Int. Cl.[6] ..... H04R 25/00

[52] U.S. Cl. ..... 381/68.2; 381/68; 381/69

[58] Field of Search ..... 381/68, 682, 68.4, 381/31, 60, 23.1, 7; 455/575, 301, 300, 128, 90; 361/814, 815, 816

[56] References Cited

U.S. PATENT DOCUMENTS

| | | | |
|---|---|---|---|
| 2,938,083 | 5/1960 | Herrmann | 381/68.7 |
| 4,187,413 | 2/1980 | Moser . | |
| 4,759,071 | 7/1988 | Heide | 381/68.4 |
| 4,882,773 | 11/1989 | Maloney | 455/617 |
| 4,993,072 | 2/1991 | Murphy | 381/113 |
| 5,051,799 | 9/1991 | Paul et al. | 381/168 |
| 5,259,033 | 11/1993 | Goodings et al. | 381/68.4 |

FOREIGN PATENT DOCUMENTS

| | | |
|---|---|---|
| 0 660 642 | 6/1995 | European Pat. Off. . |
| 89 85 80 | 12/1989 | Germany . |
| 32 05 686 | 6/1990 | Germany . |
| 43 43 702 | 3/1995 | Germany . |
| WO 95/22879 | 8/1995 | WIPO . |

OTHER PUBLICATIONS

"Microfabricated Thermal Absolute–Pressure Sensor with On–Chip Digital Front–End Processor," IEEE J. of Solid–State Circuits, vol. 26, No. 12, Dec., 1991, pp. 1998–2007.

"Lueger Lexikon der Technik," Franke, 1968, pp. 449–450.

"An Adaptive Microphone Array Processing System," Dowling et al., Microprocessors and Microsystems, vol., 16, No. 10, 1992, pp. 507–516.

"Silicon–Dioxide Electret Transducer," Hohm et al., J. of the Acoustical Soc. of America, vol. 75(4), pp. 1297–1298.

"Multipurpose Interface for Sensor Systems Fabricated by CMOS Technology with Post–Processing," Leme et al., Sensors and Actuators A, vol. 37–38, 1993, pp. 77–81.

"A Monolithic Surface Micromachined Accelerometer with Digital Output," Lu et al., IEEE Int. Solid–State Circuits Conference, pp. 160–161.

"Smart Sensor Interface with A/D Conversion and Programmable Calibration," Malcovati et al., IEEE J. of Solid–State Circuits, vol. 29, No. 8, Aug. 1994, pp. 963–966.

"Optical Direct Analog–to–Digital Conversion for Microphones," Mada et al., Applied Optics, vol. 22, No. 21, Nov. 1, 1993, pp. 3411–3413.

"Design and Test of a Precision Servoaccelerometer with Digital Output," de Coulon et al., 7 th Int. Conf. on Solid–State Sensors and Actuators, pp. 832–835.

"EMC for Product Designers," Williams, 1992, pp. 10–11, 122–129, 156–159, 166–169, 198–210 and 246–247.

*Primary Examiner*—Huyen Le
*Attorney, Agent, or Firm*—Hill & Simpson

[57] ABSTRACT

A hearing aid has at least one microphone, a digital signal conditioning stage having a signal converter, an amplifier as well as filters, and an earphone. For protection against emission of electromagnetic waves, an analog-to-digital converter is arranged in the microphone housing.

13 Claims, 2 Drawing Sheets

DIGITAL HEARING AID

BACKGROUND OF THE INVENTION

1. Field of the Invention

The present invention is directed to a hearing aid of the type having at least one microphone, a digital signal processing means including signal transducer, an amplifier and a filter stage, and an earphone.

2. Description of the Prior Art

A hearing aid of the above type is disclosed in German OS 27 16 336. In this hearing aid, a microphone is provided as an input signal source that is connected to an amplifier forming a low-pass filter. This amplifier is followed by an analog-to-digital converter that is connected to a computer stage having an output connected to a digital-to-analog converter, the latter being connected to an output amplifier to which an earphone is connected as an output transducer. The signal processing stage of the programmable hearing aid can include a microprocessor with memory and can be implemented as an integrated module. A number of input signals, for example from a microphone and from a pick-up induction coil, can thereby be correlated with one another in the processor.

In digital hearing aids of this type, the sound is picked up in analog form by the microphone. The analog microphone signal is then amplified and converted into digital signals in an analog-to-digital converter. After the signal processing, the digital signal is converted back into an analog signal that is then supplied to the earphone via an output amplifier. In particular, hearing aids to be worn on the head can come into the proximity of strong transmitters such as, for example, automobile telephones, mobile radio equipment or microwave irradiation means. The emitted electromagnetic waves often have a very high field strength in the proximity of such a transmitter. These high-frequency electromagnetic waves can, in particular, penetrate into the hearing aid through openings and have a disturbing influence on the amplifier circuit.

In order to suppress the penetration of high-frequency electromagnetic waves via seams and openings of the hearing aid housing, German OS 43 43 702 discloses forming the hearing aid housing of at least two electrically conductive parts connected to one another in electrically conductive fashion via a high-frequency seal.

SUMMARY OF THE INVENTION

Since the electromagnetic noise emission can disturbingly influence the operation of hearing aids and, particularly in hearing aids of the type initially described, the useful signals present in analog form, an object of the invention is to provide a digital hearing aid that is substantially insensitive to emission of electromagnetic waves (electro-smog).

In a hearing aid of the type initially described, this object is inventively achieved by integrating the analog-to-digital converter into the microphone housing. By accommodating the analog-to-digital converter in the housing of the microphone, the only thing still required is to communicate the digital signals, which are largely insensitive to noise, from the microphone housing to the signal-processing components (signal processing stage, output amplifier). Long signal lines are avoided due to the small spacing between the microphone and the A/D converter, and the infusion of noise signals into the analog microphone signal can be greatly reduced by the shielding of the microphone housing. In order to keep the number of terminals small, it is advantageous to transmit the digital data word in serial form over only a single signal line. A sigma-delta modulator is especially well-suited for this purpose, whereby the analog signal is converted in a fast serial bit stream. The conversion into a slower serial data stream and/or the conversion into parallel data words can ensue in a digital filter in the signal processor.

In an embodiment, a known semiconductor microphone (as disclosed, for example, in German Utility Model 8910743.8) is employed as the microphone. Such a semiconductor microphone can be arranged on a semiconductor component part monolithically integrated with a sigma-delta modulator. As a result, the connecting lines to be protected against noise emission are again shortened or entirely avoided, and the number of discrete components is reduced.

In order to prevent interference from proceeding into the microphone over the electrical supply line, it is provided that at least one capacitor can be connected between the supply lines in the proximity of the microphone.

DESCRIPTION OF THE PREFERRED EMBODIMENTS

Figure 1:
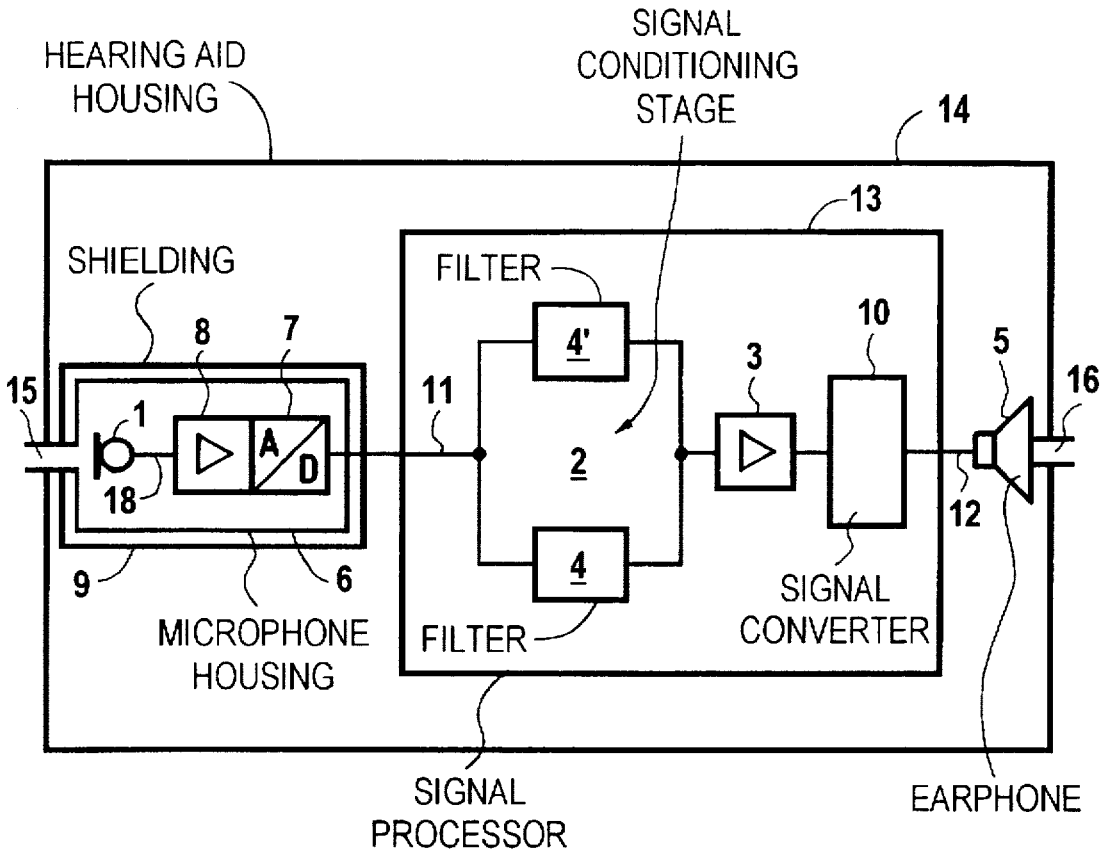
FIG. 1 is a block circuit diagram of an inventive hearing aid.

A microphone 1, followed by a signal conditioning stage 2 with an amplifier 3 and filters 4 and 4' and an earphone 5 are arranged in a hearing aid housing 14 that, for example, is composed of plastic shells. The audio signals proceed through a sound admission opening 15 to the microphone 1 which has a microphone housing 6 allocated to it. The processed audio signals emitted by the earphone 5 proceed through a sound outlet channel 16 and are supplied to the tympanic membrane.

In the digital hearing aid of FIG. 1, a microphone pre-amplifier 8 and an analog-to-digital converter 7 are arranged in the microphone housing 6 in addition to the microphone 1. The analog signal path is shortened due to the proximity of the A/D converter 7 to the microphone 1 and is shielded against noise signals by the microphone housing 6. Protection against emission from the microphone 1, the pre-amplifier 8 and the A/D converter 7 is improved further by a shielding 9 which shields against high-frequency electromagnetic waves allocated to the microphone housing 6. For example, the microphone housing 6 can be composed of electrically conductive housing parts. Alternatively, the microphone housing 6 may have an electrically conductive coating, for example of conductive lacquer or an electrical conductive foil coat. As shown in FIG. 1, the output of the A/D converter 7 supplies a digital bit stream 11 to the signal processing stage 2. In the exemplary embodiment, the signal conditioning stage 2 and a signal converter 10 are combined in a signal processor 13.

In a preferred embodiment, the signal converter 10 converts the useful output signals of the signal conditioning stage 2, encoded in digital data words, directly into further-processable pulse-time modulated signals 12, such as pulse-duration modulated or pulse-interval modulated signals, without reconversion into analog electrical signals, and the earphone 5 can be directly driven with these signals 12. A digital-to-analog conversion is superfluous according to the invention, so that saving in energy and space that are important given small hearing aids are achieved. The earphone 5 of the hearing aid is directly driven with the pulse-time modulated signals 12 in the invention. As a result, a D/A converter and a subsequent conversion of an analog signal into a pulse-duration modulated signal, for example using a delta signal that can only be produced in a complicated way, are eliminated.

Figure 2:
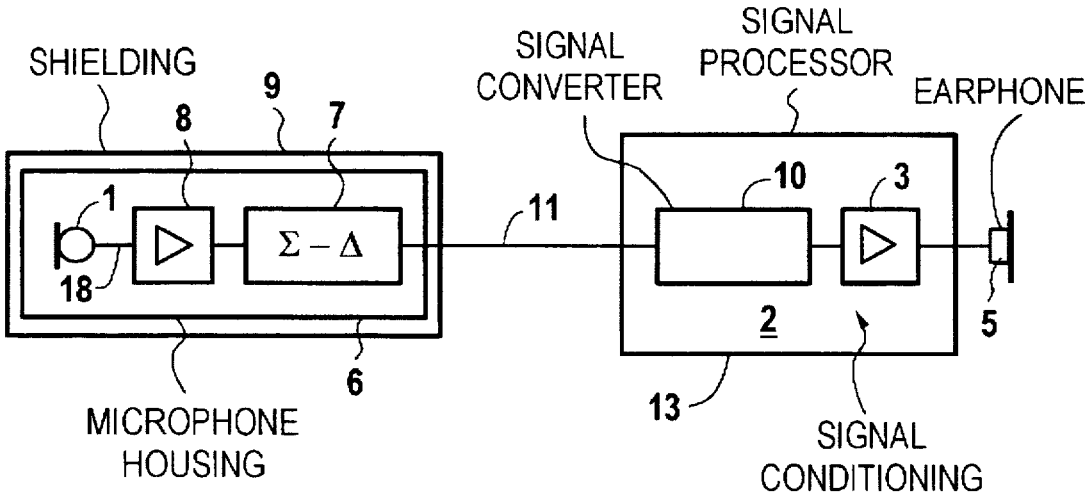
FIG. 2 shows an inventive hearing aid with a shielded microphone housing in which a sigma-delta modulator is disposed in addition to the microphone and the microphone pre-amplifier.
Figure 3:
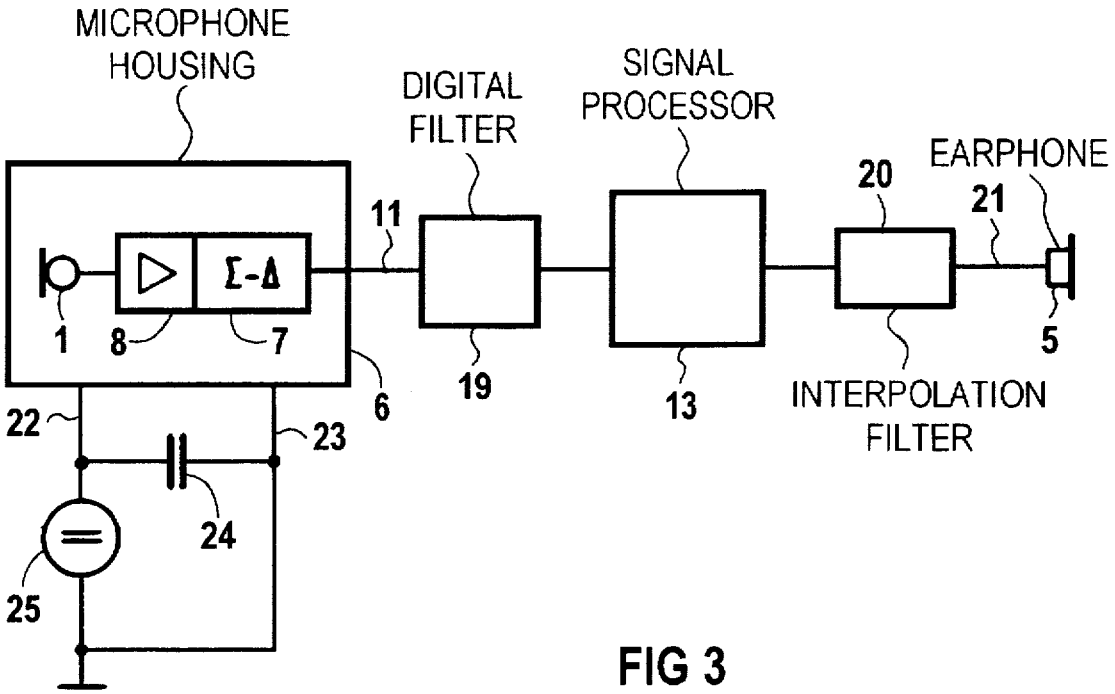
FIG. 3 is a block circuit diagram of an inventive hearing aid with the voltage source and a capacitor connected between the supply lines of the microphone.

In the embodiment of FIG. 2, a sigma-delta modulator 7' is provided as an A/D converter for the analog microphone signal 18, which converts the analog input signal 18 into a serial bit stream 11. As follows from the block circuit diagram of FIG. 3, the unit composed of the microphone 1, the microphone pre-amplifier 8 and sigma-delta modulator 7' and that supplies the bit stream 11, can be followed by a digital filter 19 that serves the purpose of reducing the data rate and/or serial-to-parallel conversion. In an advantageous development, a signal processor 13 for useful signal editing follows the decimation filter 19 in the inventive hearing aid, and an interpolation filter 20 is provided that converts the useful signals of the signal processor 13 into a fast serial bit stream 21 that is supplied to the earphone 5. In this embodiment as well, the earphone 5 can be directly driven by the pulse-time modulated bit stream 21 of the interpolation filter 20.

For voltage supply of the microphone, a voltage source 25 is shown that supplies the electrical components with the required energy via leads 22 and 23. A capacitor 24 is connected between the leads 22 and 23 in order to prevent interference from proceeding to the microphone via the leads 22 and 23.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a housing;

a microphone disposed in said housing;

an earphone disposed in said housing;

digital signal processing means for processing a signal received by said microphone for producing a signal supplied to said earphone for correcting a hearing impairment, said digital signal processing means being connected in said housing between said microphone and said earphone and including a signal converter, an amplifier and a filter stage;

a microphone housing disposed in said housing and surrounding said microphone in said housing said microphone housing comprising a shielding against high-frequency electromagnetic signals; and an analog digital converter connected between said microphone and said signal processing means and integrated into said microphone housing.

2. A hearing aid as claimed in claim 1 further comprising a microphone pre-amplifier connected between said microphone and said analog-to-digital converter and integrated into said microphone housing.

3. A hearing aid as claimed in claim 1 wherein said microphone housing is composed of electrically conductive material.

4. A hearing aid as claimed in claim 1 wherein said analog-to-digital converter comprises a sigma-delta modulator which converts an analog output signal from said microphone into a serial digital bit stream.

5. A hearing aid as claimed in claim 4 further comprising a digital filter, connected between an output of said sigma-delta modulator and an input of said signal processing means, said digital filter comprising means for performing at least one of reducing a bit rate of said serial digital bit stream and converting said serial digital bit stream into a plurality of parallel digital bit streams.

6. A hearing aid as claimed in claim 5 wherein said signal processor means includes means for converting an output of said digital filter into a processed signal, and means supplied with said processed signal for converting said processed signal into a fast serial bit stream.

7. A hearing aid as claimed in claim 6 wherein said means for converting said processed signal into a fast serial bit stream comprises means for converting said processed signal into a pulse-time modulated bit stream, and wherein said earphone comprises means for directly converting said pulse-time modulated bit stream into an audio output signal.

8. A hearing aid as claimed in claim 5 wherein said microphone comprises a semiconductor microphone.

9. A hearing aid as claimed in claim 8 wherein said sigma-delta modulator and said semiconductor microphone are monolithically integrated in a single semiconductor component.

10. A hearing aid as claimed in claim 1 wherein said microphone comprises a semiconductor microphone.

11. A hearing aid as claimed in claim 1 wherein said microphone has two leads, and further comprising a capacitor connected between said leads in proximity to said microphone.

12. A hearing aid comprising:

a housing;

a microphone disposed in said housing;

an earphone disposed in said housing;

digital signal processing means connected in said housing between said microphone and said earphone and including a signal converter an amplifier and a filter stage;

a microphone housing disposed in said housing and surrounding said microphone in said housing;

an analog digital converter connected between said microphone and said signal processing means and integrated into said microphone housing;

said amplifier and said filter stage of said digital signal processing means forming means for producing digital data words, and wherein said signal converter comprising means for converting said digital data words directly into pulse time modulated signals without re-conversion into analog signals, and said earphone composing means for directly producing an output audio signal from said pulse time modulated signals.

13. A hearing aid as claimed in claim 12 wherein all components of said signal processing means including said signal converter, are combined in a single unit.

* * * * *